United States Patent [19]

Gagne

[11] Patent Number: 4,508,418

[45] Date of Patent: Apr. 2, 1985

[54] RELEASABLE POSITION-LOCKING CONNECTOR ASSEMBLY

[75] Inventor: Donald J. Gagne, St. Paul, Minn.

[73] Assignee: Control Data Corporation, Minneapolis, Minn.

[21] Appl. No.: 523,519

[22] Filed: Aug. 15, 1983

[51] Int. Cl.[3] ..... H01R 4/48

[52] U.S. Cl. ..... 339/253 R; 339/74 R; 339/217 S

[58] Field of Search ..... 339/74 R, 217 S, 128, 339/253 R, 253 S

[56] References Cited

U.S. PATENT DOCUMENTS

| | | | |
|---|---|---|---|
| 2,524,701 | 10/1950 | Grill | 339/74 R |
| 2,691,146 | 10/1954 | Pollock | 339/217 |
| 3,144,292 | 8/1964 | Forney, Jr. | 339/128 |
| 3,178,673 | 4/1965 | Krehbiel | 339/217 |
| 3,245,030 | 4/1966 | D'Amico | 339/217 S |
| 3,474,398 | 10/1969 | Piorruneck | 339/217 |
| 3,643,211 | 2/1972 | DeLano | 339/217 |
| 3,673,541 | 6/1972 | Volinskie | 339/217 S |
| 3,980,385 | 9/1976 | Hirokawa et al. | 339/217 |
| 4,003,618 | 1/1977 | Booty | 339/22 |
| 4,010,993 | 3/1977 | Hohenberger et al. | 339/217 S |

*Primary Examiner*—John McQuade

*Attorney, Agent, or Firm*—Robert M. Angus; Joseph Genevese

[57] ABSTRACT

A connector assembly comprises a male and a female connector, the male connector having releasable lock means on its shank. The lock means includes a plurality of radially extending tongues extending outwardly from such shank, the tongues being compressible to fit within the bore of the female connector during assembly and disassembly of the connectors. The female connector includes a recess or chamber in the bore for receiving the tongues to lock the connectors together, and a flange against which the tongues may react to enable compression of the tongues an disassembly of the connectors.

3 Claims, 11 Drawing Figures

RELEASABLE POSITION-LOCKING CONNECTOR ASSEMBLY

This invention relates to electrical connectors, in particularly to matable electrical connectors which may be positively fastened to each other yet are readily separable.

Electrical connectors are widely used in electronic arts for connecting electrical circuits together. One common form of connector system is the so-called "pin" connector in which a male pin connector is matably connectable to a female receptacle connector to establish an electric circuit. Pin connectors may be of the coaxial cable type, in which case electrically separate portions of the connector are separately connected to a wire and to a shield insulated from the wire, the wire shield forming a coaxial cable. The matable receptacle connector establishes separate electrical connection to the electrically separate portions of the pin connector. Alternatively, the pin connector may be of the single-wire type, in which case a single connection is made to the mating receptable connector.

In electronic arts where a large number of connections might be established, it is important that the electrical connectors be compact, thereby requiring little space, yet the connection between the matable parts must be positive to ensure against accidental disconnection due to vibration or other environmental factors. The present invention concerns an electrical connector system, employing pin-type connectors matable with a receptacle connector in a positive fashion in such a manner that there is little likelihood of accidental disconnection of the connector system, yet the connectors may be disengaged by an operator without significant difficulty.

It is, therefore, an object of the present invention to provide a pin connector system having means for positively connecting the connector parts together, yet which is readily disengageable.

It is another object of the present invention to provide a connector system having a male pin connector having lock means which is operable to enable ready assembly of the pin connector to the mating receptacle of the female connector, the lock means being operable to positively lock the connectors together when fully assembled.

Another object of the present invention is to provide a positive-locking connector system which may be disassembled by relatively rotating the connectors to compress and release the lock means locking the connector system together.

Another object of the present invention is to provide a sleeve for mounting on a shank of a male pin connector, which sleeve includes locking means for positively locking to the receptacle of a female connector.

In accordance with the present invention, a pin connector system comprises a male pin connector having a shank. Lock means, including radially extending, compressible tongues, is mounted to the shank. The female connector includes a receptacle bore for receiving the shank of the pin connector and the lock means when the tongues are compressed. A partial counterbore or recess forms a chamber in the female connector so that the tongues may expand into the chamber formed by the counterbore to positively lock the pin connector to the female connector.

One feature of the present invention resides in a flange formed by the partial counterbore so that when the pin connector is rotated, the tongues react against the flange to compress, thereby permitting removal of the pin shank and lock means from the bore and disassembly of the connector system.

Another feature of the present invention resides in the provision of a sleeve having the tongues formed therein, the sleeve being assembled to the shank of the pin connector so that standard pin connectors may be utilized in the connector system.

The above and other features of this invention will be more fully understood from the following detailed description, and the accompanying drawings, in which.

Figure 6:
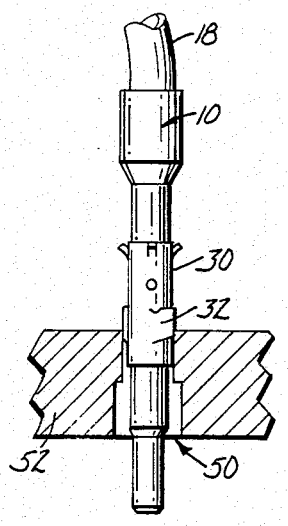
Figure 7:
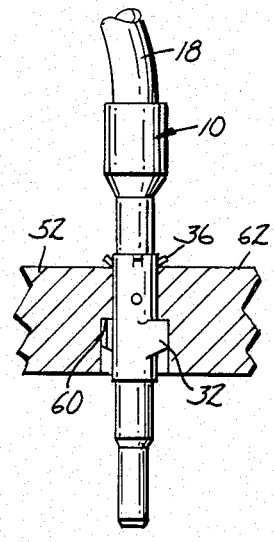
Figure 9:
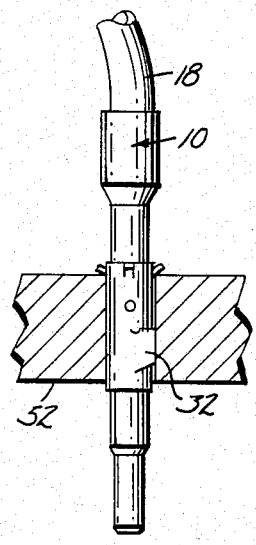
Figure 8:
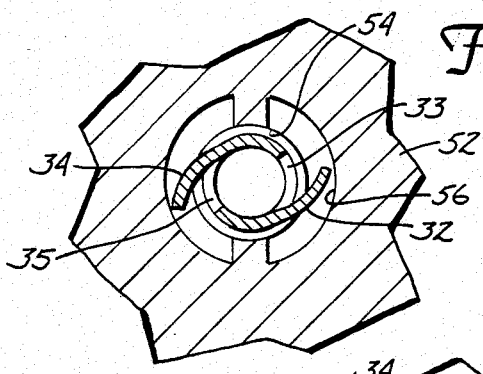
Figure 10:
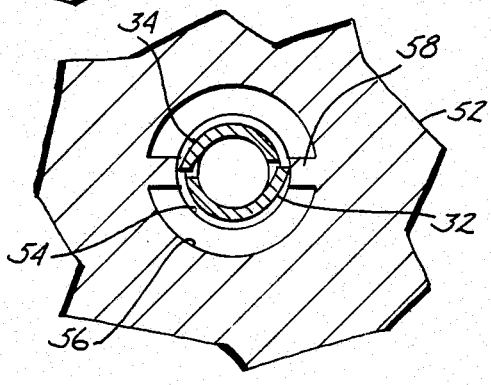

FIGS. 6 through 11 are illustrations useful in explaining the operation of the connector system in accordance with the present invention, FIGS. 6, 7, 9, and 11 being side views of the connector assembly in various stages of assemblage and disassemblage, and FIGS. 8 and 10 being section views taken along lines 8—8 and 10—10 respectively in FIGS. 7 and 9.

Referring to the drawings, there is illustrated a connector assembly in accordance with the presently preferred embodiment of the present invention. As shown in the drawings, the connector system includes a male pin connector including a body 12 having a shank 14 and a pin terminal 16. Body 12 may support a wire or cable 18 to which it is assembled. Typically, body 12, shank 14, and pin terminal 16 are cylindrical in shape, each with a successively smaller diameter. Wire or cable 18 may be a single wire connected to connector 10 by a suitable solder or other connection technique well known in the art, or it may be a coaxial cable consisting of a wire (not shown) surrounded by and insulated from a surrounding conductive shield (not shown), in which case connector 10 would have an insulated portion (not shown) to separate the two conductive paths. As shown particularly in FIGS. 1 and 3, the shank 14 of connector 10 includes recess 20 extending radially inwardly of the shank surface.

Figure 4:
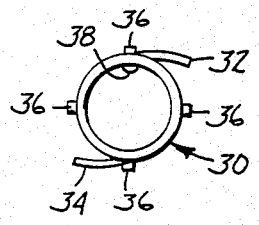
FIG. 4 is an end view of a portion of the connector system taken along line 4—4 in FIG. 1.
Figure 5:
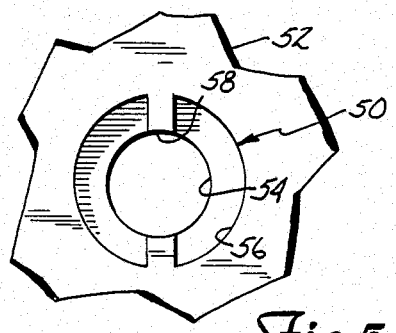
FIG. 5 is an end view of a portion of the connector system taken along line 5—5 of FIG. 1.

Sleeve 30 is assembled to shank 14 of connector 10. Sleeve 30 may be constructed of a suitable metal, or it may be constructed of an insulator material such as plastic. In either case, sleeve 30 is generally cylindrical in shape and is constructed of a suitable resilient material. Cut or punched from the sides of sleeve 30 are radially protruding tongues 32 and 34 which protrude outwardly from the cylindrical shape of sleeve 30 in a somewhat spiral manner particularly shown in FIG. 4. As shown particularly in FIG. 1, tongues 32 and 34 have an upper surface 42 extending substantially normal to the axis of the connector and a lower sloped surface 44 extending upwardly and outwardly from the sleeve surface. Conveniently, tongues 32 and 34 may be formed by stamping and bending the tongues out from the side portions of the cylindrical material forming sleeve 30 leaving mating apertures 33 and 35 into which the tongues may fit upon compression (see FIG. 8).

Figure 1:
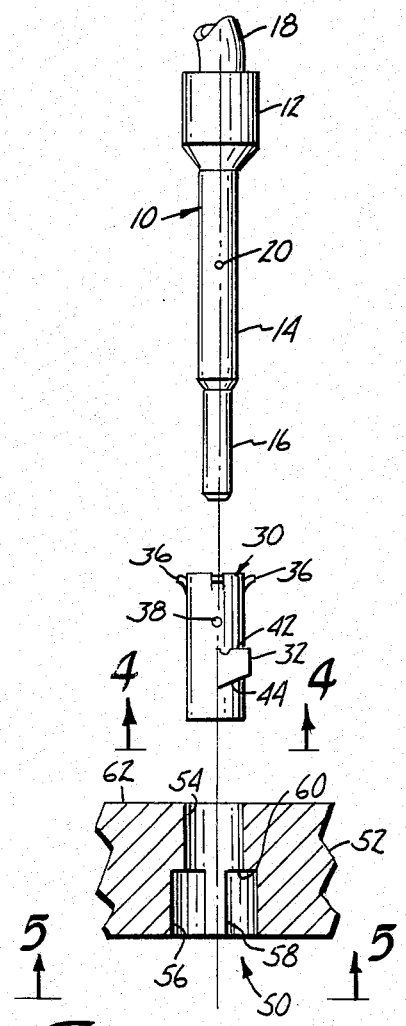
FIG. 1 is an exploded side view of a connector assembly in accordance with the present invention.
Figure 2:
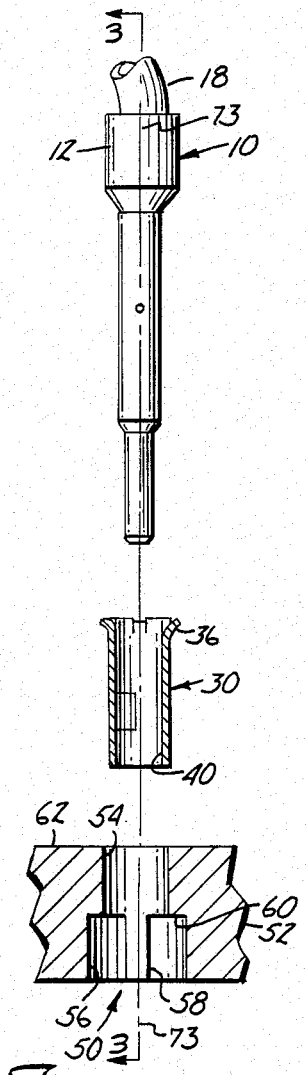
FIG. 2 is a cut-away view as in FIG. 1 of the connector system in accordance with the present invention.
Figure 3:
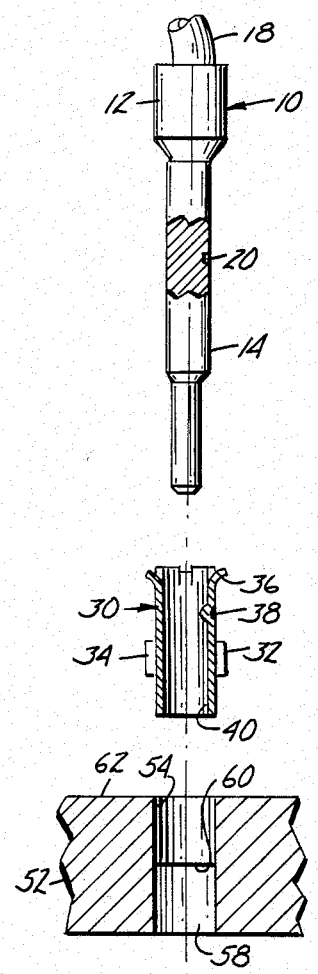
FIG. 3 is a section view taken along line 3—3 in FIG. 2.

Barbs 36 protrude downwardly and outwardly of sleeve 30, and they also may be formed by stamping and bending from the material forming sleeve 30. Detent 38, particularly illustrated in FIGS. 1 and 3, is adapted to engage recess 20 in shank 14 of connector 10. Preferably, the inside surface 40 of sleeve 30 snugly engages shank 14 of connector 10, so that when assembled to the connector, sleeve 30 tightly engages the connector without rotation on the shank nor movement along the axis of the pin. Conveniently, sleeve 30 is a slit sleeve not completely surrounding shank 14 so that sleeve 30 merely envelops and clamps to a substantial portion of shank 14.

Connector 10 is engageable to a mating female receptacle 50 formed in housing 52. Typically, housing 52 may comprise a suitable circuit board or the like useable in the electronic arts. Receptacle 50 comprises a bore 54 having a diameter only slightly larger than the outside diameter of sleeve 30. Bore 54 extends through circuit board 52. If receptacle 50 is formed in a housing, bore 54 extends into the housing at least a distance equal to the length of pin terminal 16 and that much of shank 14 to the level of barbs 36. From the opposite side of circuit board 52, or within the housing forming receptacle 50, is a counterbore or recess forming chamber 56. Chamber 56 is of larger diameter than bore 54, and preferably is approximately the diameter formed by the extended tongues 32 and 34 when in the relaxed position shown in FIG. 4. Chamber 56, however, does not extend around the entire periphery of bore 54, but instead extends only partially about the periphery of bore 54 so as to form radial flange 58 at the same diameter and configuration as bore 54. Annular shoulder 60 is formed by the junction of chamber 56 and bore 54.

Figure 11:
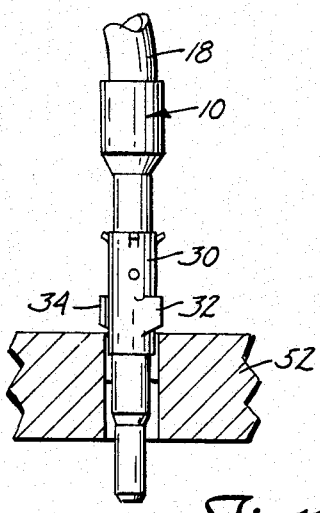

With reference to FIGS. 6 through 11, the assembly and disassembly of the pin connector system in accordance with the present invention may be readily explained. In FIG. 6, the male pin connector 10 is being assembled into the female connector 50 of circuit board or housing 52. To accomplish the insertion within bore 54, the pin may be inserted axially into bore 54 and at the same time rotated clockwise (from the top as shown in the drawings) to permit sloped surface of 44 of tongues 32 and 34 to react against the lip of bore 54 at the upper surface 62 of the circuit board or housing to compress the tongues as they are inserted within bore 54. When the connector system is fully assembled as illustrated in FIGS. 7 and 8, tongues 32 and 34 expand to their relaxed position within chamber 56, and surface 42 on the tongues engages shoulder 60 to prevent removal of the pin from its assembled position. Barbs 36 on sleeve 30 engage the upper surface 62 of circuit board or housing 52 to prevent pin 10 from being inserted too deeply into the housing or circuit board. When it is desired to remove the pin from its assembled position, the pin connector is again rotated in a clockwise direction (from the top as shown in the drawings) and withdrawn axially, causing tongues 32 and 34 to react against flange 58 to thereby compress to the position as shown in FIGS. 9 and 10 to permit their ready removal through bore 54 as illustrated in FIG. 11.

The present invention thus provides a connector system for releasably locking a pin terminal to a mating receptacle terminal in a circuit board or housing. The tongues of the connector system may be manufactured as part of the pin terminal or may be fabricated from a sleeve fastenable to a pin terminal. The connector assembly according to the present invention is compact and does not require a significant amount of space. The connector assembly according to the present invention is well suited for computer applications and other applications of electrical arts where high density is required. The system is effective in operation and inexpensive to produce and use.

This invention is not to be limited by the embodiment shown in the drawings and described in the description, which is given by way of example and not of limitation, but only in accordance with the scope of the appended claims.

What is claimed is:

1. A connector assembly comprising a male pin connector and a matable female receptacle connector, said male connector having a shank having an axis, and lock means supported by said shank including a plurality of compressible tongues extending generally radially outwardly of said shank, said tongues having an upper surface and a lower sloped surface, said female connector comprising a body having a surface, and axial bore in said body for receiving said shank, said bore forming a lip at said surface, a recess in said bore remote from said surface for receiving said tongues and forming a shoulder and a flange in said recess, whereby said pin connector may be assembled to said receptacle connector by relatively rotating said connectors causing said lower sloped surface of said tongues to react against said lip causing said tongues to compress to fit within said bore and relative axial movement of said connectors permits said tongues to be received in said recess so that said tongues expand and said upper surface of said tongues react against said shoulder to lock the connectors together, and whereby said pin connector may be disassembled from said receptacle connector by relatively rotating said connectors causing said tongues to react against said flange to thereby compress said tongues to fit within said bore.

2. Apparatus according to claim 1 wherein said lock means comprises a sleeve fastened to said shank, said tongues being formed from the body of said sleeve.

3. Apparatus according to claim 2 further including detent means on said sleeve adapted to be received in recess means in said shank for fastening said sleeve to said shank.

* * * * *